US006094495A

United States Patent [19]

Rocha

[11] Patent Number: 6,094,495

[45] Date of Patent: Jul. 25, 2000

[54] HORN-TYPE LOUDSPEAKER SYSTEM

[75] Inventor: Jeffrey A. Rocha, Douglas, Mass.

[73] Assignee: Eastern Acoustic Works, Inc., Whitinsville, Mass.

[21] Appl. No.: 09/160,107

[22] Filed: Sep. 24, 1998

[51] Int. Cl.[7] ..... H04R 25/00

[52] U.S. Cl. ..... 381/340; 381/337; 381/343; 181/152

[58] Field of Search ..... 381/343, 340, 381/337, 338, 339, 341, 342, 424, 423, 431; 181/152, 159, 177, 179, 187, 192

[56] References Cited

U.S. PATENT DOCUMENTS

| | | | |
|---|---|---|---|
| Re. 32,183 | 6/1986 | Isaacs | 181/185 |
| 2,615,995 | 10/1952 | Voigt | 381/340 |
| 3,139,490 | 6/1964 | Lyons | 381/396 |
| 4,050,541 | 9/1977 | Henricksen | 181/159 |
| 4,164,631 | 8/1979 | Garner et al. | 381/340 |
| 4,176,731 | 12/1979 | Sinclair | 181/192 |
| 4,180,710 | 12/1979 | Spranger | 179/115.5 H |
| 4,187,926 | 2/1980 | Henricksen et al. | 181/192 |
| 4,325,456 | 4/1982 | Ureda | 181/159 |
| 4,836,327 | 6/1989 | Andrews et al. | 181/152 |
| 4,882,562 | 11/1989 | Andrews et al. | 340/388 |
| 4,885,782 | 12/1989 | Eberbach | 381/186 |
| 5,386,479 | 1/1995 | Hersh | 381/190 |
| 5,526,456 | 6/1996 | Heinz | 381/156 |
| 5,642,429 | 6/1997 | Janssen | 381/182 |
| 6,026,928 | 2/2000 | Maharaj | 181/152 |

*Primary Examiner*—Curtis A. Kuntz
*Assistant Examiner*—Phylesha Dabney
*Attorney, Agent, or Firm*—McDermott, Will & Emery

[57] ABSTRACT

An improved horn-type loudspeaker system for reproducing an acoustical signal from a corresponding electrical signal includes transducer assembly, an acoustical transformer and an output horn assembly. The transducer assembly includes an inner driver cone, an outer driver cone and a dust cap constructed such that the direct path length from the voice coil to the outer driver cone periphery is substantially equal to the distance from the voice coil to the dust cap peak. Mechanical vibrations produced by the voice coil propagate to the outer driver cone periphery and to the dust cap peak in the same amount of time; thus the acoustical signals transmitted by the outer driver cone periphery and the dust cap peak are substantially time-coherent. The acoustical signal transmitted by the transducer assembly is directed toward the horn assembly by an acoustical transformer through plurality of radial waveguides. The location and form of the waveguides efficiently transfers the acoustical signal from the transducer to the horn, without converting the source to a ring radiator, thereby preserving the source directivity. The shape and proximity of the acoustical transformer to the transducer also provides a uniform, low mechanical reactance to the transducer assembly. The acoustical transformer further includes a throat mode barrier which interferes with the formation of extraneous modes in the beginning of the horn assembly.

7 Claims, 7 Drawing Sheets

FIG. 6
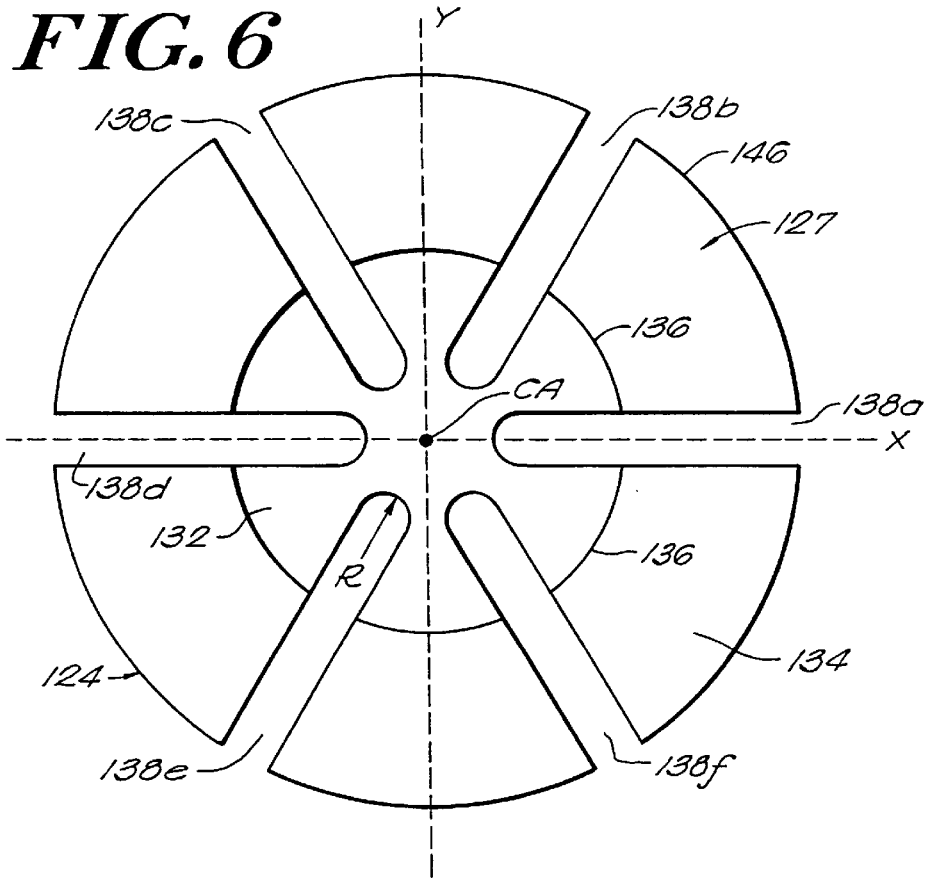
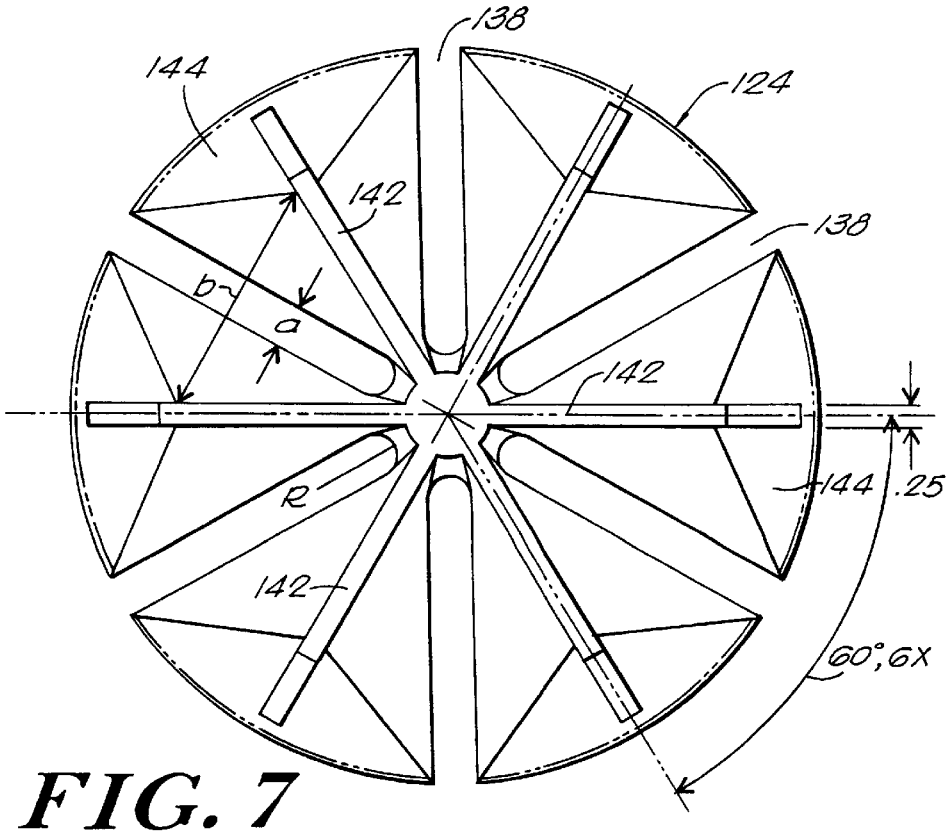
FIG. 7

HORN-TYPE LOUDSPEAKER SYSTEM

CROSS-REFERENCE TO RELATED APPLICATIONS

Not Applicable.

STATEMENT REGARDING FEDERALLY SPONSORED RESEARCH

Not Applicable.

REFERENCE TO MICROFICHE APPENDIX

Not Applicable

FIELD OF THE INVENTION

The present invention relates to loudspeaker systems, and more particularly to loudspeaker systems which efficiently and accurately couple acoustical energy from an electrical/acoustical transducer to the open air.

BACKGROUND OF THE INVENTION

A loudspeaker is a device which converts an electrical signal into an acoustical signal (i.e., sound) and directs the acoustical signal to one or more listeners. In general, a loudspeaker includes an electromagnetic transducer which receives and transforms the electrical signal into a mechanical vibration. The mechanical vibrations produce localized variations in pressure about the ambient atmospheric pressure; the pressure variations propagate within the atmospheric medium to form the acoustical signal. A horn-type loudspeaker typically includes a transducer assembly, an acoustical transformer and an acoustical waveguide or horn. The transducer assembly may include a cone-type driver 10 as shown in the sectional view of FIG. 1, wherein a voice coil 12 receives the electrical signal via input terminals 14 and produces mechanical vibrations in an annular cone 16 as a function of the electrical signal. The cone-type driver 10 further includes a dust cap 18 attached to and covering the voice coil 12. Consequently, the voice coil also produces mechanical vibrations in the dust cap 18. The cone-type driver 10 is typically constructed to be symmetric about a central axis 20. The majority of the acoustical signal is radiated from the cone, with contribution from the cone periphery 22 and the dust cap 18.

An acoustical transformer 26 (alternately known as a phase plug) is typically disposed adjacent to the cone 16 as shown in the sectional view of FIG. 2. The purpose of the acoustical transformer 26 is to reduce the volume of the air chamber driven by the cone-type driver 10. Without the acoustical transformer 26, the mechanical reactance of the acoustical system facing the driver 10 is high, only permitting mechanical vibrations in the cone 16 and dust cap 18 at lower frequencies. As the frequency of the mechanical vibrations increases, the high mechanical reactance damps the vibrations, thus reducing the radiating efficiency of the driver. The presence of the acoustical transformer 26 creates a reduced air volume chamber 28. This in turn reduces the mechanical reactance, thus allowing mechanical vibrations of the cone 16 and dust cap 18 at higher frequencies.

An acoustical waveguide (or alternately a horn) receives the acoustical signal radiated by the driver and acoustical transformer and directs the signal in a particular direction. In general, the transmission pattern of the driver/impedance matching assemblies is larger than the region bounded by the horn. The horn tends to constrict the transmission pattern of the driver/acoustical transformer, thus increasing the directivity of the overall loudspeaker.

A typical prior art cone-type driver 10 exhibits a disadvantage in that sound radiated from the cone periphery 22 is not coherent in time with the sound radiated from the dust cap peak 24. This is true because the path length from the voice coil 12 to the cone periphery 22 is longer than the path length from the voice coil 12 to the dust cap peak 24. Although the time difference may be only a few microseconds, it is enough to color the resulting acoustical signal radiated from the driver 10 such that the acoustical signal is not a true representation of the original acoustical source. A further disadvantage of the prior art driver 10 is that the presence of its phase plug substantially blocks all but the periphery of the horn throat, producing what is essentially a "ring radiator." As the frequency of the driver 10 increases, the acoustical output becomes more directional. Although any radiator will exhibit this effect to some extent, the directionality of a ring radiator increases more rapidly with respect to frequency than a direct radiating cone-type driver.

It is an object of this invention to provide a loudspeaker system that substantially overcomes or reduces the aforementioned disadvantages while providing other advantages which will be evident hereinafter.

SUMMARY OF THE INVENTION

The present invention is a loudspeaker system for receiving an electrical signal and transmitting an acoustical signal through a transmission medium. The system includes a transducer assembly which receives the electrical signal and produces the acoustical signal representative of the electrical signal. The transducer assembly produces acoustical energy from a plurality of radiating regions. The system further includes an acoustical transformer which matches the transducer assembly to the transmission medium, receives the acoustical signal from substantially all of the radiating regions of the transducer assembly, and directs the acoustical signal in a predetermined direction.

In one embodiment, the driver assembly includes a cone-type driver having a voice coil disposed about a central axis, a cone coaxial with and fixedly attached to the voice coil, and a dust cap coaxial with and fixedly attached to the cone. The distance from the voice coil to the peak of the dust cap is substantially equal to the distance from the voice coil to the outer periphery of the cone.

In other embodiments the cone may include two distinct components; an outer cone coaxial with and fixedly attached to the voice coil, and an inner cone coaxial with and fixedly attached to the voice coil, such that substantially the same shape and functionality provided by a single cone is provided by two distinct cones.

In another embodiment, the acoustical transformer including a phase plug core disposed about the central axis and having a first face and a second face, disposed at opposite ends of the core. The first face is substantially adjacent to said cone-type driver and has a contour which substantially matches the outer cone, the inner cone and dust cap of the cone-type driver so as to form a uniform air chamber or spacing between the mutually confronting faces of the acoustical transformer and the cone-type driver.

In another embodiment, the acoustical transformer is provided with a plurality of channels or acoustical waveguides through the acoustical transformer substantially parallel to the central axis. The waveguides preferably widen in a direction parallel to the central axis and away from the first face, such that each of the waveguides is narrowest at the first face and widest at the second face.

In yet another embodiment, the acoustical transformer includes a throat mode barrier disposed about the central axis, substantially adjacent and fixedly attached to the acoustical transformer. The throat mode barrier further includes a plurality of radially directed fins.

BRIEF DESCRIPTION OF THE DRAWINGS

The foregoing and other objects of this invention, the various features thereof, as well as the invention itself, may be more fully understood from the following description, when read together with the accompanying drawings in which:

FIG. 6 shows a rear schematic view of the transducer assembly and phase plug core of the acoustical transformer shown in FIG. 5;

FIG. 7 shows a front view of the phase plug core of the acoustical transformer shown in FIGS. 3–6;

DETAILED DESCRIPTION OF THE INVENTION

Figure 1:
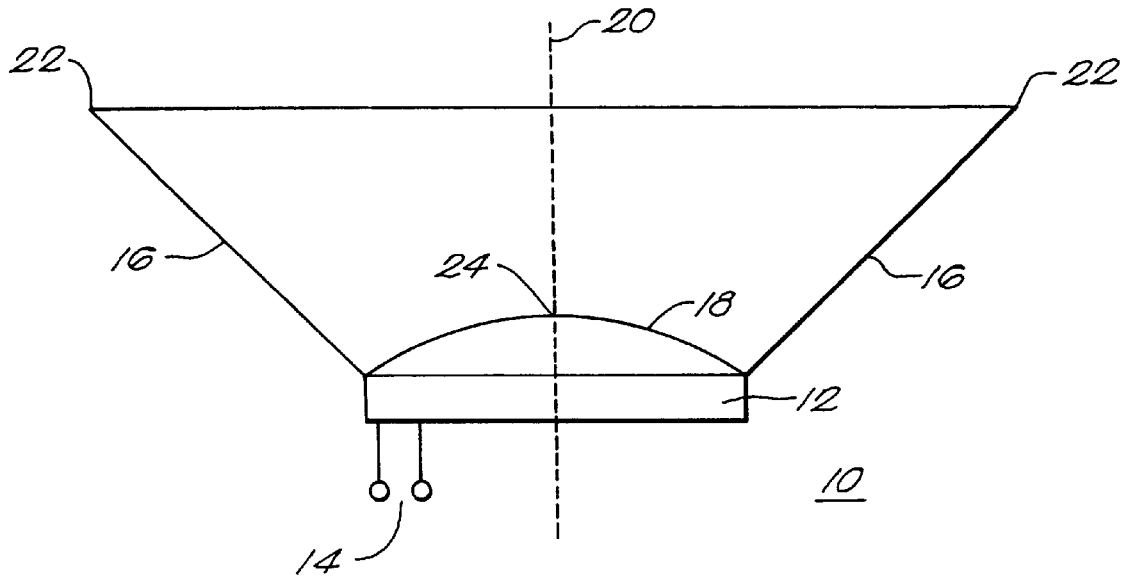
FIG. 1 (PRIOR ART)
FIG. 1 shows a sectional view of a prior art transducer assembly.
Figure 2:
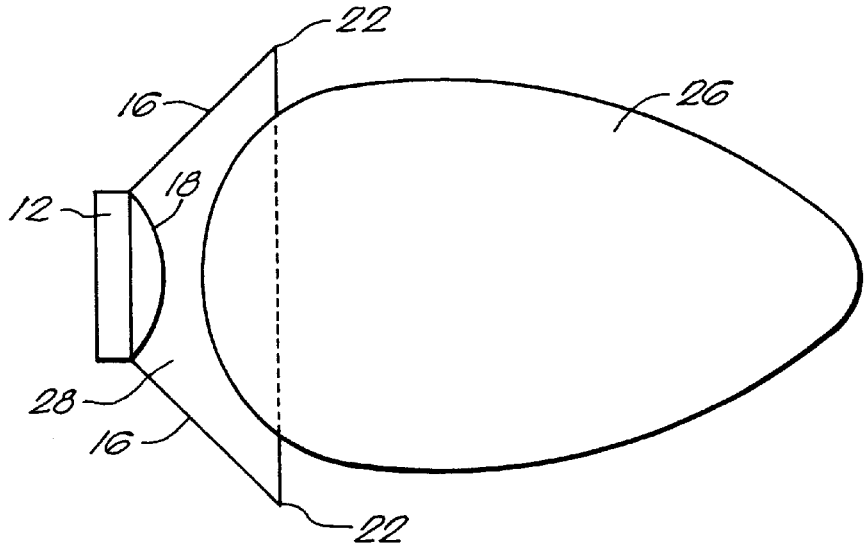
FIG. 2 (PRIOR ART)
FIG. 2 shows a sectional view of a prior art transducer assembly in conjunction with a prior art phase plug.
Figure 3A:
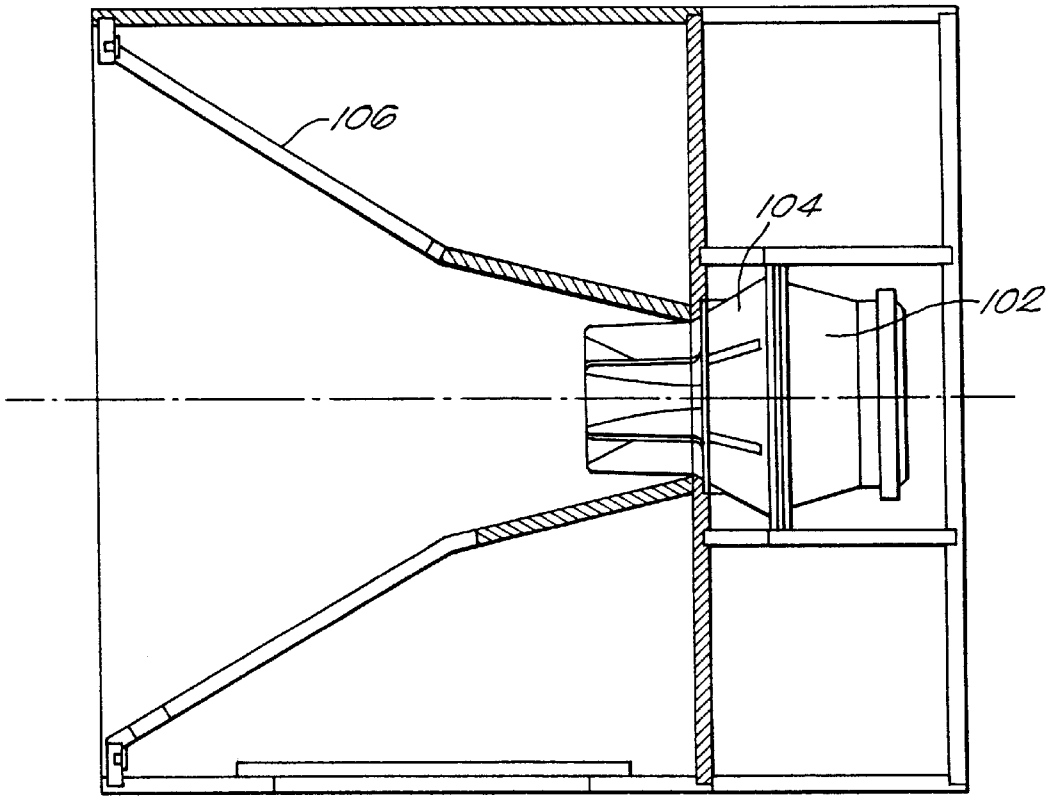
FIG. 3A shows a sectional view of one preferred embodiment of an improved horn-type loudspeaker system of the present invention.
Figure 3B:
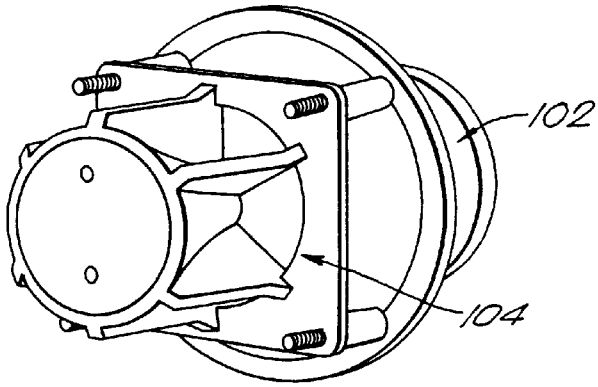
FIG. 3B shows a perspective view of a transducer assembly and an acoustical transformer of the system shown in FIG. 3A, assembled as a unit according to the present invention.
Figure 3C:
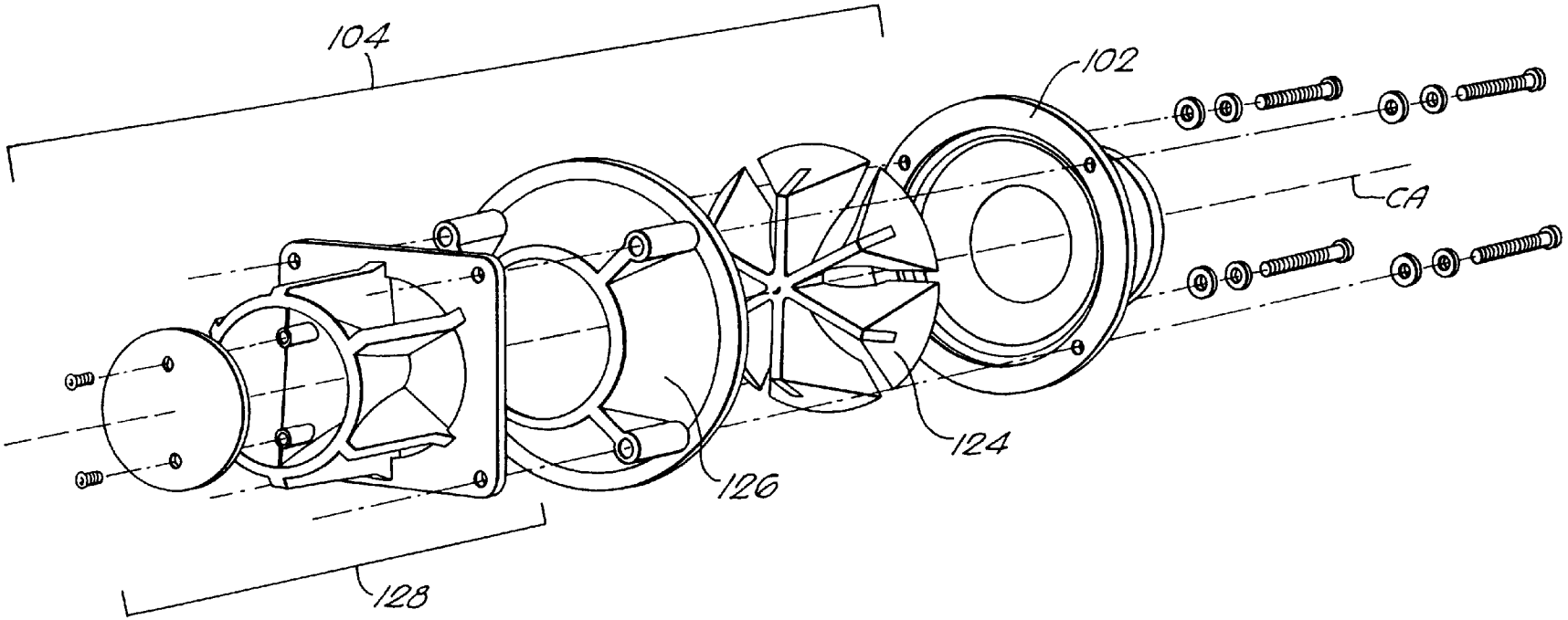
FIG. 3C shows an exploded perspective view of the transducer assembly and acoustical transformer of FIG. 3B.

The invention is directed to an improved horn-type loudspeaker system for reproducing an acoustical signal from a corresponding electrical signal. FIG. 3A illustrates one preferred embodiment of an improved horn-type loudspeaker system 100, including a transducer assembly 102, an acoustical transformer 104 and an output horn assembly 106. FIG. 3B shows a perspective view of the transducer assembly 102 and an acoustical transformer 104 assembled as a unit. FIG. 3C shows an exploded perspective view of a transducer assembly 102 and an acoustical transformer 104.

Figure 4:
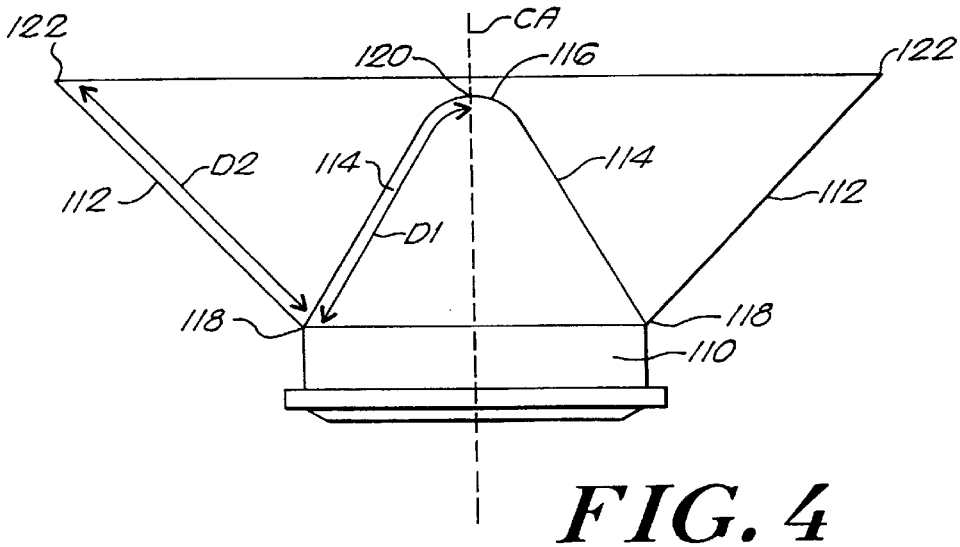
FIG. 4 shows a simplified sectional view of the transducer assembly of the system of FIGS. 3A–3C.

According to one preferred embodiment, the transducer assembly 102, shown in more detail in the sectional view of FIG. 4, includes a voice coil 110, a cone having an outer portion 112 and an inner portion 114 of the cone and a dust cap 116. In the illustrated embodiment, the cone is continuous, and the outer portion 112 and the inner portion 114 are designated separately for illustrative purposes only. In other embodiments, the cone may include separate inner and outer portions which are assembled to form a cone having substantially the same shape and properties as the cone shown and described in FIG. 4. The sectional view of FIG. 4 shows one half of the transducer assembly sectioned at the central axis CA, which is preferably the axis of propagation of the acoustic energy generated by the system. Both the outer portion 112 and the inner portion 114 of the driver cone are in the form of a cone truncated at both ends. The periphery of the smaller end of the outer portion 112 and the periphery of the larger end of the inner portion 114 coincide at a junction 118, and the cone is fixedly attached to the voice coil 110 at junction 118. The dust cap 116 is fixedly attached to the inner portion 114 of the driver cone, and intersects the central axis CA at the dust cap peak 120. The distance from junction 118 to dust cap peak 120 along inner portion 114 and dust cap 116 is designated in FIG. 4 as D1. The distance from junction 118 to outer periphery 122 along outer portion 112 is designated as D2. In one preferred embodiment of the present invention, the distance D1 is substantially equal to the distance D2. Mechanical vibrations originated by the voice coil 110 are imparted to the outer portion 112 and to the inner portion 114 at junction 118. Mechanical vibrations travel through the outer portion 112 and the inner portion 114 along equidistant paths D2 and D1, respectively, thus the dust cap peak 120 and the outer periphery 122 produce acoustical signals which have a substantially equal time relationship. Sound produced from the dust cap peak 120 and the outer periphery 122 is coherent, and adds constructively (because of the equal time relationship), along the central axis CA (i.e., on-axis) and thus results in a true representation of the electrical signal received by the transducer assembly 102. Such coherent transmission is only possible when the speed of the mechanical vibrations along paths D1 and D2 are substantially equal. This is true in the illustrated embodiment because the inner portion 114, the outer portion 112 and the dust cap 116 are fabricated from the same material. Other embodiments may include dissimilar materials along the paths D1 and D2, provided the speed of propagation of the mechanical vibrations within the dissimilar materials is substantially equal.

The acoustical transformer 104, shown in the exploded perspective view of FIG. 3C, includes a phase plug core 124, a phase plug body 126, and a throat mode barrier 128. The phase plug core 124 is disposed substantially symmetrically about the central axis CA and substantially adjacent to the transducer assembly 102, as shown in the sectional view of FIG. 5. The phase plug core 124 is situated with respect to the transducer assembly so as to form a reduced volume air chamber 130 between the rear face 127 of the phase plug core 124 and the transmitting face 129 of the transducer assembly 102. This reduced volume air chamber 130 permits higher frequencies to be transmitted to the horn by the transducer assembly 102 than if the transducer were driving an open air chamber. The contour of the rear face 127 of the phase plug core 124 is shaped to match the contour of the outer driver cone 112, the inner driver cone 114 and the dust cap 116, so as to maintain a uniform air chamber 130 over the entire transmitting face of the transducer assembly 102, i.e., the spacing between the rear face 127 of phase plug core 124 and the front face 129 of the transducer assembly 102 is substantially constant throughout the mutually confronting faces of the phase plug core and transducer assembly. The uniform air chamber 130 presents a uniform load to the entire transmitting face of the transducer assembly 102, which results in an efficient conversion of mechanical vibrations to acoustical energy. The rear face of the phase plug core 124 includes a first conical section 132 which faces the outer conical portion 112 of the cone, and a second conical section 134 which faces the inner portion 114 of the cone and the dust cap 116. In one preferred embodiment, the first conical section 132 and the second conical section 134 meet at a peak 136. This peak 136 extends at least in sections around the axis CA opposite to where the outer driver cone attaches to the voice coil when the phase plug is properly secured relative to the transducer assembly 102. Preferably, the peak is contoured as close as possible to match the contour made by the outer driver cone where it attaches to voice coil 110. Thus, the peak is rounded as shown, although the peak can be formed as a sharp edge.

Figure 5:
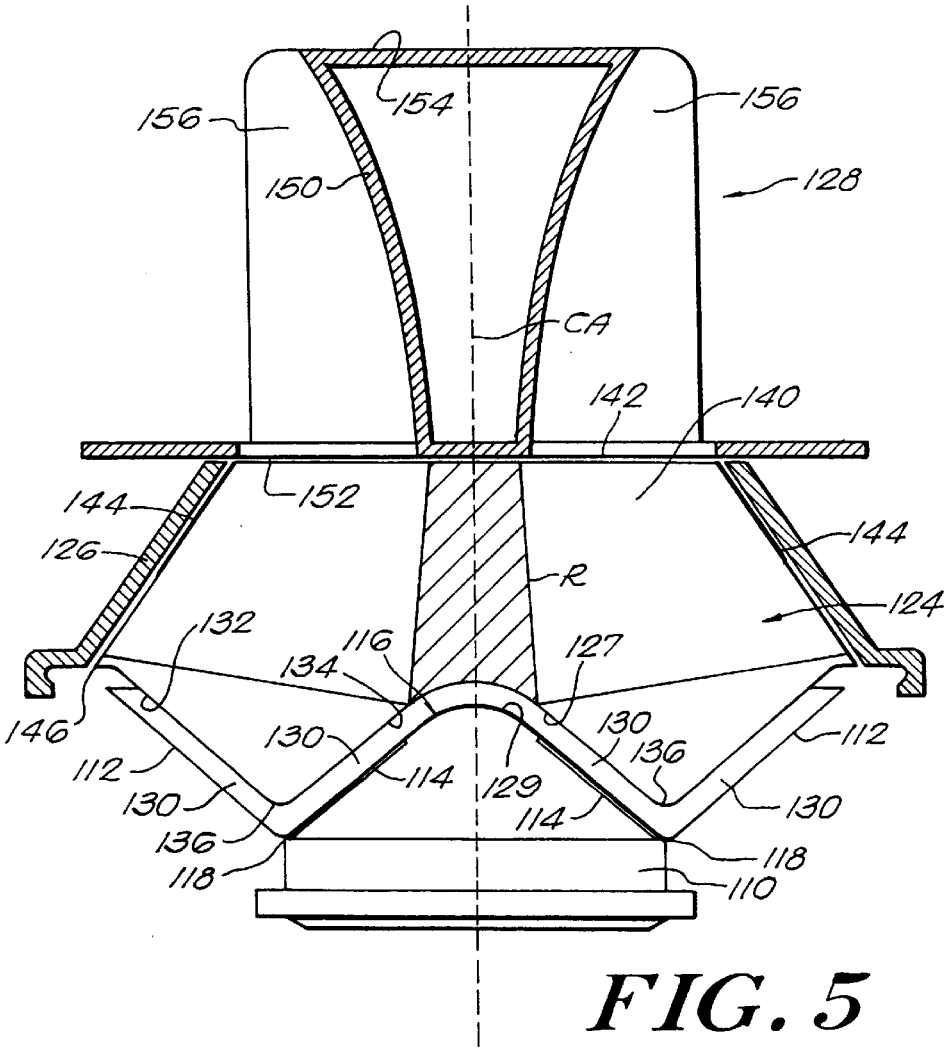
FIG. 5 shows a sectional schematic view of the transducer assembly and acoustical transformer arranged according to the present invention.

As seen in FIG. 5, the phase plug core 124 further includes a front section 140 having a front face 142 which preferably is flat and a side surface 144, the latter being tapered with increasing radius from the front face 142 to the peripheral edge 146 where the side surface 144 connects to the second conical section 134. The plug core thus is tapered from the edge 146, decreasing in diameter in both directions along the axis CA.

As shown in FIG. 6, the rear face of the phase plug core 124, which is situated opposite the transducer assembly 102. A solid line, labeled 136, is used to indicate the location of the peak 136. The central axis CA is shown as a point at the center of the face of the acoustical transformer. As FIG. 6 illustrates, the acoustical transformer preferably includes a plurality of elongated radial slots 138, with six being shown at 138*a* through 138*f* (although the number of slots can vary), extending radially from an inner radial location R out to the edge 146. The radial distance of radial location R from the axis CA preferably decreases from the first conical section to the rear face 142.

In the illustrated embodiment, the slots 138 are identical and are distributed about the central axis CA at equal angle intervals. There is an advantage of making the number of slots other than a multiple of four. As shown, the segments of the core between the slots are each symmetrically disposed 180° from another segment, so that for any two collinear slots (e.g., slots disposed 180° apart), the region of the phase plug core 124 along an axis orthogonal to the collinear axis (e.g., the Y axis is disposed 90° from an X axis extending through the center of the slots 138*a* and 138*d* in FIG. 6) is a solid mass. This particular configuration tends to reduce "breakup modes" from transmitting into the horn of the loudspeaker system by decoupling the acoustical energy established within halves and/or quadrants of the horn assembly.

Each of the elongated slots 138 forms with the phase plug body 126 an internal acoustical waveguide which passes through the phase plug core 124 in the direction of the central axis CA. FIG. 7, which provides a view of the front face of the phase plug core 124, illustrates the six internal waveguides. As FIG. 7 shows, the width of each slot (and thus the internal waveguide) increases as the waveguide passes through the phase plug core 124 from the rear face 127 to the front face 142. This widening of each internal waveguide allows sound produced by the transducer assembly 102 to gradually expand spatially as it propagates through each waveguide so as to conform to the aperture size and shape of the output horn assembly 106. As shown in FIG. 7, each slot expands from a width of "a" at its narrowest, where sound enters the waveguide, to a width of "b" at its widest where the sound exits.

The phase plug body 126 is disposed substantially symmetrically about the central axis CA and substantially adjacent to the phase plug core 124, as shown in the exploded perspective view of FIG. 3C and schematically in FIG. 5. When the acoustical transformer is assembled, the phase plug body 126 is fixedly attached to the transducer assembly 102, thus completely enclosing the phase plug core 124 as shown in FIG. 3B and FIG. 5. The phase plug body 126 provides an exterior boundary for the phase plug core and an aperture for the input of the horn which extends beyond the throat mode barrier 128 and is shown at 106 in FIG. 3A.

In the illustrated embodiment, the phase plug core 124 and phase plug body 126 exist as distinct components that, when assembled, form a portion of the acoustical transformer 104. In other embodiments, the phase plug body 126 and the phase plug core 124 may exist as a single unit.

The throat mode barrier 128 is disposed substantially symmetrically about the central axis CA and substantially in front of the phase plug body 126, as shown in the exploded perspective view of FIG. 3C and schematically in FIG. 5. The throat mode barrier 128 is essentially a doubly truncated cone 150, symmetrically disposed about the central axis CA, having the smaller end 152 (the barrier rear face) facing toward the transducer assembly 102 and the larger end 154 (the barrier front face) facing toward the horn assembly 106. In the illustrated embodiment, the walls of the cone 150 include some curvature, although in other forms of the invention the cone 150 may be a true conical section. The throat mode barrier 128 further includes a plurality of fins 156 extending radially away from and equally angularly spaced around the central axis CA. Preferably the number of fins equals the number of slots of the phase plug core 124. Thus, in the illustrated embodiment, the throat mode barrier preferably includes six fins equally distributed at 60 degree intervals about the central axis AC, although it should be appreciated that the number of fins may include more or less than six fins. The throat mode barrier 128 is positioned with respect to the phase plug core 124 such that the spaces between the fins of the throat mode barrier are axially aligned and thus coincide with, and effectively extend, the internal waveguides provided by the slots through the phase plug core 124. More specifically, the fins 156 are angularly aligned around the axis CA with the flat portion of the rear face 142 which remains between each of the slots 138 of the phase plug core 124. The fins 156 extending from the throat mode barrier 128 tend to disrupt extraneous modes which may be set up in the region of the loudspeaker immediately outside of the waveguides formed by the slots of the phase plug body (i.e., the area in the throat of the horn). In the illustrated embodiment, the phase plug core 124, the phase plug body 126 and the throat mode barrier 128 exist as distinct components, that, when assembled, form the acoustical transformer 104. In other embodiments, the phase plug core 124, the phase plug body 126 and/or the throat mode barrier may exist as a single unit.

Figure 8A:
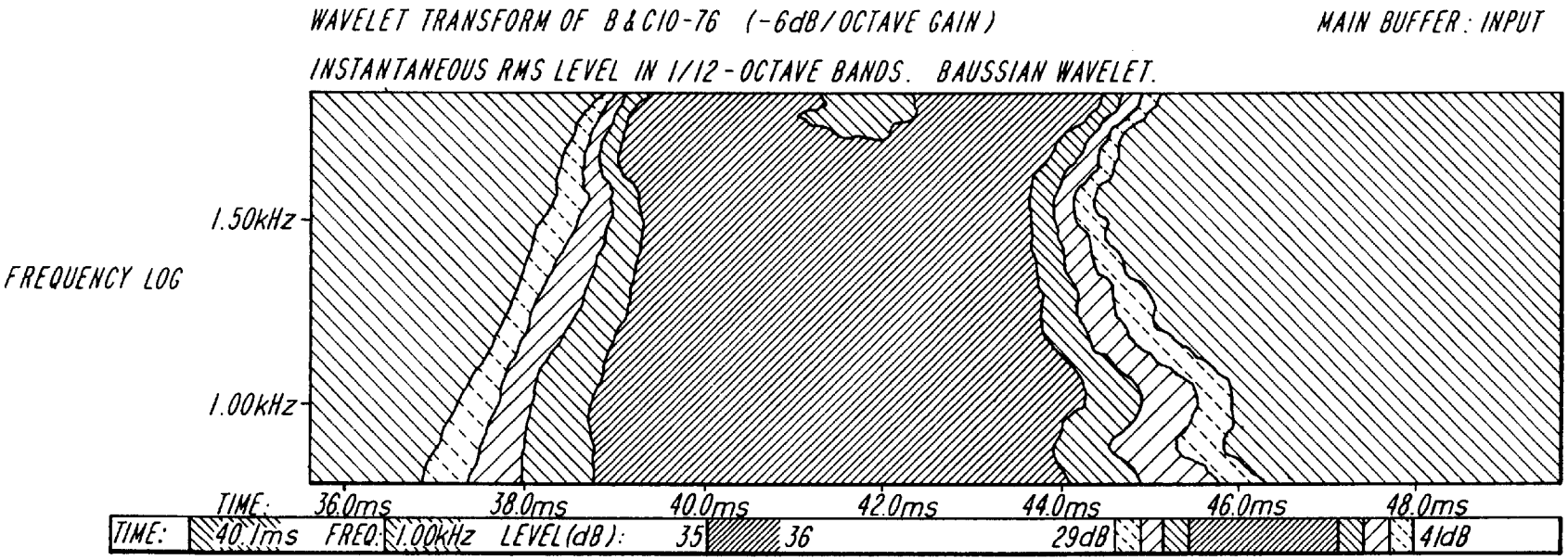
FIG. 8A shows a wavelet transform graphic representative of the output of a loudspeaker constructed according to the present invention.
Figure 8B:
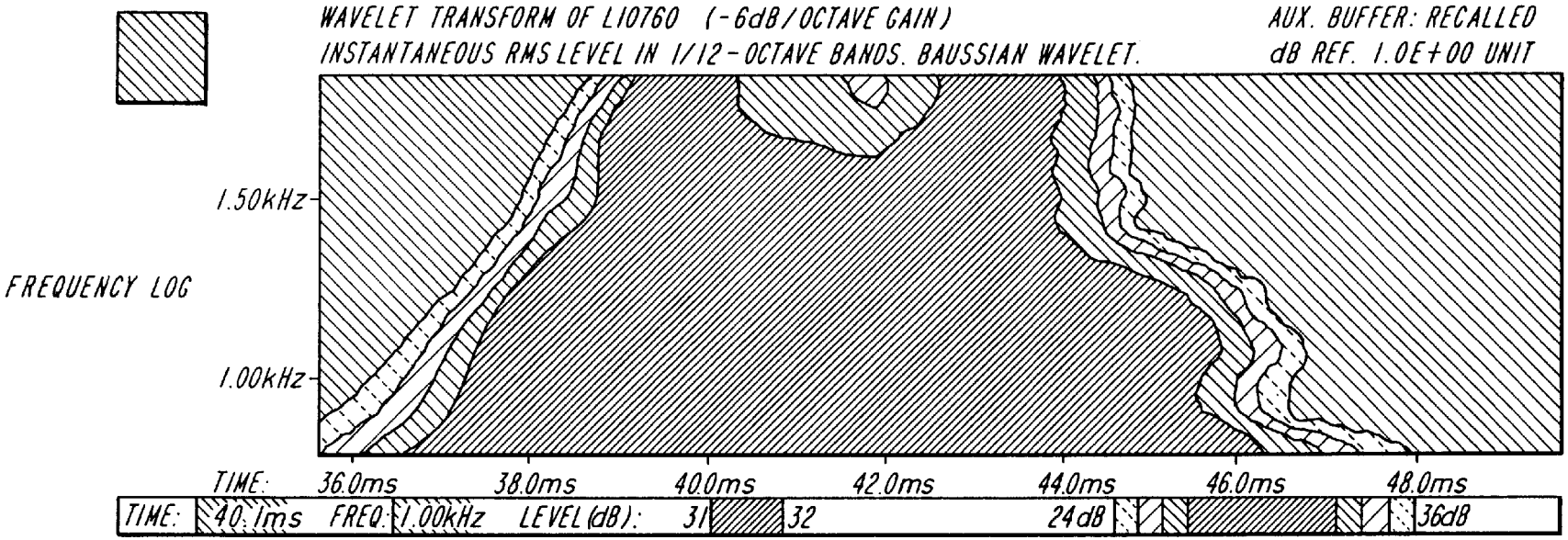
FIG. 8B shows a wavelet transform graphic representative of the output of a prior art loudspeaker.

The primary advantage of the present invention over the prior art is illustrated in FIG. 8A and FIG. 8B. Both figures are wavelet transform graphics which plot RMS output level of an acoustical source via grayscale coloring against time on the abscissa and against frequency on the ordinate. Each figure shows a wavelet graphic of the output of an acoustical device mounted in a large baffle. The results achieved by illustrated embodiment of the present invention is illustrated in FIG. 8A. The results achieved by a prior art device having a prior art phase plug is shown in FIG. 8B. The is little difference between the two devices with respect to frequency response; both devices show a rising frequency response with increasing frequency. The primary difference is apparent in the time domain. FIG. 8A indicates that the invention provides a tighter, more coherent arrival pattern as compared to the prior art in FIG. 8B. Also, the boundaries of the energy information are much closer to vertical as compared to the prior art, which means that acoustical information from the invention arrives at a receiver in a more coincident fashion with respect to frequency. FIG. 8B indicates that the signal from the prior art source is more spread out over time, and further indicates some significant irregularities within the passband which are not present in FIG. 8A.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. A loudspeaker system for receiving an electrical signal and transmitting an acoustical signal through a transmission medium, comprising:

a transducer assembly for receiving said electrical signal and producing said acoustical signal representative of said electrical signal, said transducer assembly having a plurality of radiating regions, said transducer assembly including a cone type driver having a voice coil disposed uniformly about a central axis, an inner cone coaxial with and fixedly attached to said voice coil, an outer cone coaxial with and fixedly attached to said inner cone, and a dust cap coaxial with and fixedly attached to said inner cone, a dust cap peak being defined by an intersection of said central axis and said dust cap; and, an acoustical transformer for matching said transducer assembly to said transmission medium, for receiving said acoustical signal from substantially all said radiating regions of said transducer assembly, and for directing said acoustical signal in a predetermined direction wherein a first distance extending perpendicularly from said voice coil along said inner cone to said dust cap peak is substantially equal to a second distance extending perpendicularly from said voice coil along said outer cone to an outer periphery of said outer cone.

2. A loudspeaker system according to claim 1, wherein said acoustical transformer includes a phase plug core being disposed uniformly about said central axis and having a first face and a second face at opposite ends of said core, said first face being substantially adjacent to said cone-type driver.

3. A loudspeaker system according to claim 2, said first face having a contour substantially matching said cone element and said dust cap of said cone-type driver so as to form a uniform air chamber between said acoustical transformer and said cone-type driver.

4. A loudspeaker system according to claim 2, wherein said core defines at least in part a plurality of waveguides through said acoustical transformer substantially parallel to said central axis.

5. A loudspeaker system according to claim 4, wherein said waveguides widen along said central axis in a direction away from said first face, such that each of said waveguide is narrowest at said first face and widest at said second face.

6. A loudspeaker system according to claim 2, said phase plug core being enclosed by a phase plug body having an aperture substantially opposite said second face, such that said waveguides direct an acoustical signal produced by said driver assembly toward said aperture.

7. A loudspeaker system according to claim 1, said acoustical transformer further including a throat mode barrier disposed about said central axis, substantially adjacent and fixedly attached to said acoustical transformer, said throat mode barrier including a plurality of fins extending radially from said central axis.

* * * * *